US005230380A

United States Patent [19]

Sato

[11] Patent Number: 5,230,380

[45] Date of Patent: Jul. 27, 1993

[54] MOLDS FOR CONTINUOUS CASTING OF STEEL

[75] Inventor: Takayuki Sato, Osaka, Japan

[73] Assignee: Satosen Co., Ltd., Osaka, Japan

[21] Appl. No.: 895,243

[22] Filed: Jun. 8, 1992

Related U.S. Application Data

[63] Continuation of Ser. No. 474,771, Mar. 16, 1990, filed as PCT/JP89/00723, Jul. 20, 1989, abandoned.

[30] Foreign Application Priority Data

Jul. 22, 1988 [JP] Japan ..... 63-184145

[51] Int. Cl.[5] ..... B22C 9/06

[52] U.S. Cl. ..... 164/418; 164/138

[58] Field of Search ..... 164/418, 138

[56] References Cited

U.S. PATENT DOCUMENTS

| | | | |
|---|---|---|---|
| 4,037,646 | 7/1977 | Hara | 164/418 |
| 4,538,667 | 9/1985 | Hara | 164/418 |

FOREIGN PATENT DOCUMENTS

| | | | |
|---|---|---|---|
| 2625914 | 12/1976 | Fed. Rep. of Germany | 164/418 |
| 2314001 | 1/1977 | France . | |
| 51-147431 | 12/1976 | Japan . | |
| 54-124831 | 9/1979 | Japan | 164/418 |
| 55-100851 | 8/1980 | Japan | 164/138 |
| 56-68554 | 6/1981 | Japan | 164/418 |
| 56-68555 | 6/1981 | Japan | 164/138 |
| 57-68248 | 4/1982 | Japan | 164/138 |
| 57-85650 | 5/1982 | Japan | 164/138 |
| 59-54444 | 3/1983 | Japan . | |
| 58-173061 | 10/1983 | Japan | 164/418 |
| 59-5385 | 2/1984 | Japan . | |
| 61-162245 | 7/1986 | Japan | 164/138 |
| 62-270249 | 11/1987 | Japan . | |
| 2027375 | 2/1980 | United Kingdom | 164/418 |
| 2100154 | 12/1982 | United Kingdom | 164/418 |

OTHER PUBLICATIONS

European search report Aug. 11, 1990, EP 89908510.

*Primary Examiner*—Mark Rosenbaum
*Assistant Examiner*—Rex E. Pelto
*Attorney, Agent, or Firm*—Armstrong, Westerman, Hattori, McLeland & Naughton

[57] ABSTRACT

This invention provides a copper or copper alloy mold for continuous casting of steel characterized in that a nickel-boron alloy plating layer containing 0.06 to 0.3 wt. % of boron is formed on its interior surface.

2 Claims, 2 Drawing Sheets

MOLDS FOR CONTINUOUS CASTING OF STEEL

This application is a continuation of application Ser. No. 07/474,771, filed Mar. 16, 1990, filed as PCT/JP89/00723, Jul. 20, 1989, now abandoned.

TECHNICAL FIELD

The present invention relates to a mold for continuous casting of steel, such as low carbon steel, high carbon steel, stainless steel, special steel, etc. and more particularly to a mold for continuous casting of steel which has an extended useful life.

BACKGROUND ART

The mold for continuous casting of steel is so designed that molten steel poured from its top end is solidified by cooling and the resulting product is withdrawn from its lower end in a continuous sequence. As such, from productivity points of view, the mold is required to have a long service life. The long-life continuous casting mold heretofore known is the one disclosed in Japanese Examined Patent Publication No. 40341/1980. This mold comprises a copper or copper alloy body and as formed on the internal surface thereof which is to be exposed to molten steel, (A) an intermediate plating layer comprising at least one member selected from the group consisting of nickel and cobalt and (B) a surface alloy plating layer formed from either 3 to 20 weight % of phosphorus or 2 to 15 weight % of boron or both and the balance of at least one member selected from the group consisting of nickel and cobalt. The reasons why this mold has a long life are allegedly as follows. One of the reasons is that the provision of said intermediate layer (A) serves to flatten the gradient of hardness between the copper or copper alloy mold body which is very low in hardness and the alloy layer (B) which has a high hardness to thereby increase the bond between the three members, viz the body metal, intermediate layer and alloy layer. The other reason is that the alloy layer has high resistances to heat and wear at high temperature.

As improved versions of the above-mentioned mold, there also are known the mold carrying a chromium plating layer in superimposition on said alloy layer (B) (Japanese Examined Patent Publication No. 50734/1977) and the mold carrying an oxide layer as formed by oxidizing said alloy layer (B) (Japanese Examined Patent Publication No. 50733/1977). The chromium plating layer and the oxide layer in these molds serve to preclude deposition of molten steel splashes evolved at the start of casting on the mold surface and eliminates chances for breakout troubles. Thanks to this feature and the above-mentioned increased intimacy of the three members, namely the mold body, intermediate layer and alloy layer and the high wear resistance of the alloy layer at high temperature, these molds have serviceable lives even longer than the life of the first-mentioned mold described in Japanese Examined Patent Publication No. 40341/1980.

The above-mentioned molds carrying two or three protective layers essentially have an intermediate layer comprising at least one member of the group consisting of nickel and cobalt and, as disposed thereon, an alloy layer and, in the case of three-layer molds, further a chromium plating layer or an oxide layer, and, as such, require complicated manufacturing procedures and high production costs.

DISCLOSURE OF THE INVENTION

In connection with a mold wherein molten steel is charged at its top and solidified product is withdrawn from its bottom, the present inventor conducted an intensive research to develop a protective layer which is structurally simple and easy to manufacture and which is to be formed over a substrate mold body (a plate or tube of copper or copper alloy which constitutes the internal surface of a mold). As a consequence, the inventor surprisingly discovered that notwithstanding the widely-accepted notion that nickel-boron alloy plating in general are poorly bonded to substrate copper or copper alloy, a nickel-boron alloy plating layer with a low boron content in a certain specific range has a good ability to bond to the substrate copper or copper alloy and serves on its own as an excellent protective layer even without the provision of an intermediate layer used in the foregoing prior art mold, thus providing for the manufacture of a mold having a life at least equal to or even longer than the lives of the above-mentioned mold having two or three superposed protective layers. The further research by the inventor led to the finding that a mold having a long life, which is unexpected from the conventional knowledge, can also be produced by forming an under plating layer consisting essentially of at least one of nickel and cobalt and, in superimposition thereon, a nickel-boron alloy plating layer with a low boron content. The present invention is predicated on the above findings.

Referring, now, to the accompanying drawings.

Figure 1:
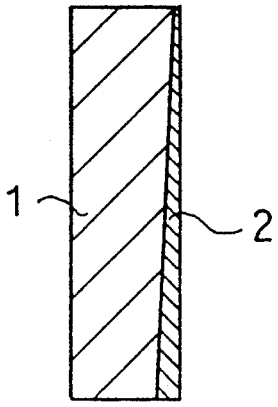
FIG. 1 is a vertical section view showing an example of the mold having a nickel-boron alloy plating layer in a tapered fashion according to the invention.

The present invention provides a mold for continuous casting of steel which is characterized in that the mold has a nickel-boron alloy plating layer containing 0.05 to 1.5 weight % of boron on its inner surface.

In accordance with the present invention, the simple structure of a substrate mold body and a nickel-boron alloy plating layer with a boron content in the above specific range as formed over the substrate mold body assures a mold life which is at least comparable or even longer than the lives of the conventional molds having two or three superposed protective layers. This is quite unexpected in view of the facts that a nickel-boron alloy plating layer was believed to have a poor ability to bond to substrate copper or copper alloy, that a boron content not more than 2 weight % was considered to be inadequate in terms of heat resistance and hardness, and that it was considered essential to form a chromium plating layer on the alloy layer or to oxidize the alloy layer to form an oxide layer in order that the deposition of splashes may be positively precluded.

While the detailed reason why the mold of the invention has such an extended life is not fully clear, it is presumably based on the following: the nickel-boron alloy layer containing 0.05 to 1.5 weight % of boron has a high ability to bond to the substrate copper or copper alloy of the mold and has a coefficient of thermal expansion similar to that of the substrate copper or copper alloy, and this alloy layer has a microvickers hardness of about 500 to 800 HV, high wear resistance at high temperature, high lubricating property at high temperature, remarkably high heat conductivity to allow a rapid dissipation of heat which prevents formation of a major temperature gradient, and a low affinity for molten steel which tends to preclude deposition of splashes.

In addition to the extended life of the mold, the following advantages are achieved by the present invention.

(a) In the prior art mold disclosed in Japanese Examined Patent Publication No. 40341/1980, the alloy layer has a high boron content of 2 to 15 weight % and is so hard as to give rise to a strain by stress. Moreover, it has a low thermal conductivity and therefore may cause a large temperature gradient. Therefore, there was a likelihood that cracks are formed. In contrast, the alloy layer according to the invention has a low risk of cracking and assures a high reliability of the mold.

(b) Since the alloy layer according to the invention has a very high thermal conductivity, it achieves a very high cooling efficiency.

In the mold for continuous casting of steel according to the invention, the substrate body of the mold is made of copper or copper alloy. This copper alloy may be virtually any of the alloys heretofore used in the art. For example, alloys of copper with small amounts, particularly about 0.02 to 0.12 weight %, of at least one element selected from the group consisting of silver, iron, tin, zirconium, phosphorus, etc. can be mentioned. Particularly preferred copper alloys are deoxidized coppers containing small amounts of phosphorus and copper alloys containing 0.1 weight % of iron, 0.04 weight % of tin and 0.03 weight % of phosphorus.

In the present invention, the foregoing specific nickel-boron alloy layer is formed on the above-mentioned substrate mold body. The method usable for this purpose is not limited but includes the following as an example. First, the surface of the mold body is pretreated in the conventional manner. This pretreatment may, for example, be conducted by serially conducting electrolytic degreasing for 30 minutes at $10A/dm^2$ using an iron plate as the cathode, rinsing with water, rinsing with 50% hydrochloric acid, rinsing with water and rinsing with 3% sulfamic acid. After the above pretreatment, the above-mentioned nickel-boron alloy plating layer with a specified low boron content is formed. If the boron content of the alloy layer is less than 0.05 weight %, the microvickers hardness of the layer is reduced and the wear resistance and lubricating property at high temperature also tend to be lowered. Conversely if the boron content exceeds 1.5 weight %, the coefficient of thermal expansion tends to be decreased to cause an inadequate bond to the substrate metal, and the resulting decreased thermal conductivity and poor dissipation of heat tends to increase internal stress of the alloy layer and consequent likelihood of cracking. From the standpoints of high temperature wear resistance, lubricating property, thermal conductivity and resistance to cracking, the boron content is preferably in the range of about 0.05 to 0.7 weight % and more preferably in the range of about 0.06 to 0.3 weight %.

The thickness of this alloy layer can be chosen from a broad range according to the particular application of the mold, and the like. Generally, it is about 50 μm to 2 mm, preferably about 50 μm to 1.5 mm, and more preferably about 100 μm to 2 mm uniformly throughout the whole surface area of the substrate mold body. If the thickness of the alloy layer is less than 50 μm, local wear may develop due to operational damage to adversely affect the mold life. On the other hand, increasing the thickness beyond 2 mm is not rewarded with further improved effect but is uneconomical.

Figure 2:
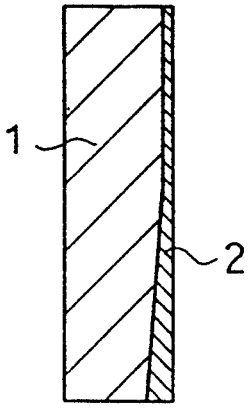
FIGS. 2 to 5 are vertical section views showing other examples of the mold having a nickel-boron plating layer according to the invention.
Figure 3:
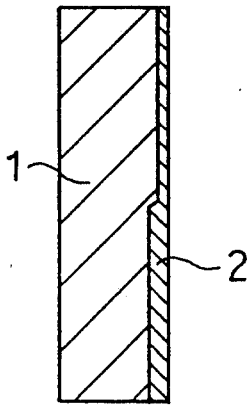
Figure 4:
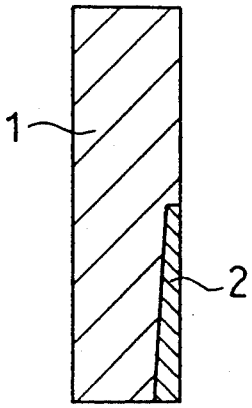
Figure 5:
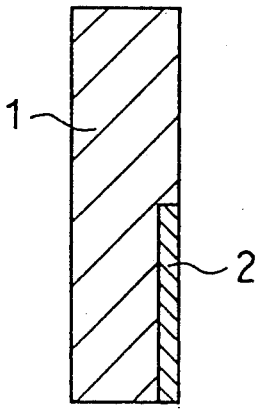

According to the research by the inventor, the thickness of said nickel-boron alloy plating layer of the mold of the invention may be about 50 μm to about 2 mm, preferably about 50 μm to about 1.5 mm, and more preferably about 100 μm to about 1 mm in the lower half of the inner surface of the mold body. In the area corresponding to the upper half of the mold, the thickness of the alloy plating layer may be less than 50 μm or even there may be no alloy layer with the substrate copper or copper alloy remaining exposed. In the present invention, therefore, it is possible to finish the mold body (1) in such a manner that its thickness decreases continually from its top end to its bottom end and to deposit the alloy layer (2) in a tapered fashion such that its thickness increases continually from said top end to said bottom end as illustrated in FIG. 1. In this connection, the gradient of the taper can be chosen from a broad range but it is generally preferable to assure that the thickness of the alloy layer of the invention is about 0 to about 100 μm at the top end, and about 150 μm to about 2 mm and preferably about 200 μm to about 1 mm at the bottom end. More desirably, the alloy plating layer has a taper such that the difference between its top end thickness and its bottom end thickness is about 500 to 1000 μm. Alternatively, as illustrated in FIGS. 2 and 3, the alloy layer (2) may be formed in such a fashion that it is then in the upper half and thick in the lower half of the mold. Furthermore, as shown in FIGS. 4 and 5, the alloy layer (2) may be formed only in the area corresponding to the lower half of the mold body. In any case, the alloy layer (2) may be formed in such a manner that as in the case illustrated in FIG. 1, its thickness is about 50 μm to 2 mm in the area corresponding to the lower half of the mold body.

The formation of the above nickel-boron alloy plating layer may be effected by the conventional electroplating technique or the conventional non-electrolytic plating technique. When the thickness of the alloy layer is to be large, the electroplating process is more advantageous. For the formation of said alloy layer by the non-electrolytic plating technique, the following plating bath may, for example, be employed.

| | |
|---|---|
| Nickel sulfate | 20–30 g/l |
| Sodium potassium tartarate | 30–40 g/l |
| Sodium borohydride | 2.0–2.5 g/l |
| pH | 12.0–12.5 |
| Temperature | 45–50° C. |

For the formation of the alloy layer by the electroplating technique, the following plating bath, for instance, may be employed.

| | |
|---|---|
| Nickel sulfate | 250–300 g/l |
| Nickel chloride | 20–25 g/l |
| Boric acid | 30–40 g/l |
| Dimethylamineborane | 0.01–0.3 g/l |
| Stress reducing agent | 0–suitable amount |

-continued

| | |
|---|---|
| Surfactant | 0–1.5 g/l |
| pH | 3.0–4.0 |
| Bath temperature | 40–45° C. |
| Current density | 1–3 A/dm$^2$ |

In addition to the above plating baths, any other plating bath capable of yielding a nickel-boron alloy plating layer with the specified boron content can also be employed.

The above nickel-boron alloy plating layer varying in thickness from the top end to the bottom end can be formed, for example, by carrying out the plating procedure with the anode inclined and, then, finishing the resulting plating layer by machining if necessary.

As already mentioned, the inventor of the present invention further discovered that a long-life mold to which splashes are difficult to adhere can also be obtained by forming a plating layer consisting essentially of at least one of nickel and cobalt on the copper or copper alloy substrate and, then, forming on said plating layer a nickel-boron alloy plating layer with a boron content of about 0.05 to about 0.5 weight %, preferably about 0.05 to about 0.30 weight %.

Thus, the present invention provides a copper- or copper alloy-based mold for continuous casting of steel which has a plating layer formed on the inner surface of said mold and consisting essentially of at least one of nickel and cobalt, and a nickel-boron alloy plating layer formed on said plating layer and containing about 0.05 to 0.5 weight %, preferably about 0.05 to 0.30 weight %, of boron.

In this connection, the plating layer comprising at least one of nickel and cobalt (hereinafter referred to as "under layer") has a good ability to bond to both of the above-mentioned alloy plating layer and the copper or copper alloy substrate, thus serving as a protective film of good bonding ability as a whole, and this good bonding ability coupled with the excellent high-temperature wear resistance and lubricating property, good heat-dissipating property and good splash-repellency of the alloy plating layer appears to synergistically assure an extended life of the resulting mold.

The above result is totally unexpected in view of the facts that Japanese Examined Patent Publication No. 40341/1980 referred to hereinbefore, for instance, mentions that a boron content of less than 2 weight % is unsatisfactory in terms of heat resistance and hardness and that Japanese Examined Patent Publication No. 50733/1977 and other literature recommend the provision of a chromium plating layer or an oxide layer for positive prevention of the adherence of splashes.

Furthermore, the mold of the present invention which has the above-mentioned under layer and alloy layer has not only the above-mentioned advantage of extended mold life but also the advantage that even if the alloy layer is damaged to a certain extent by external physical forces, etc., the mold can still be serviceable because of the presence of the under layer.

The above-mentioned under layer consisting essentially of at least one of nickel and cobalt can be easily provided by pretreating the surface of the mold body in the conventional manner and, then, electroplating the surface in the usual manner. As to the alloy layer, it is exactly the same as the nickel-boron alloy layer mentioned hereinbefore and formed, after the formation of said under layer, by the aforementioned electroplating or non-electrolytic plating technique. The thickness of the under layer and that of the alloy layer can also be chosen from broad ranges as mentioned hereinbefore. Generally, the minimum thickness of the alloy layer is about 50 μm and the total thickness of the under layer and alloy layer is about 100 μm to about 3 mm and preferably about 100 μm to about 2 mm.

Figure 6:
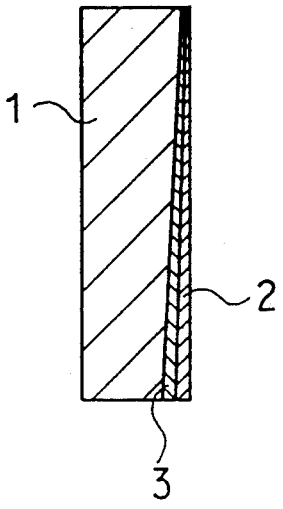
FIG. 6 is a vertical section view showing an example of the mold having an under layer and a nickel-boron alloy plating layer in a tapered fashion in accordance with the invention.
Figure 7:
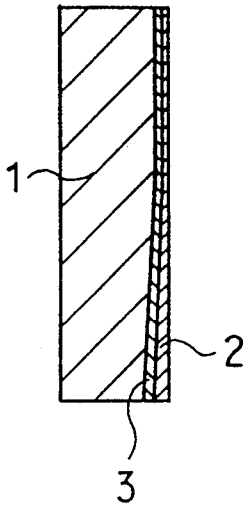
FIGS. 7 to 10 are vertical section views showing other examples of the mold having an under layer and a nickel-boron alloy plating layer in accordance with the invention.
Figure 8:
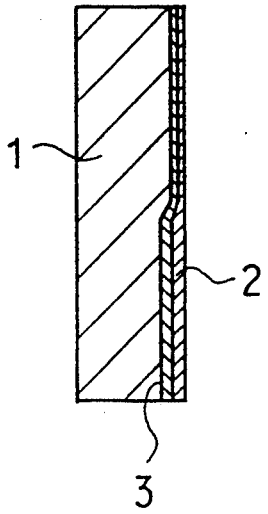
Figure 9:
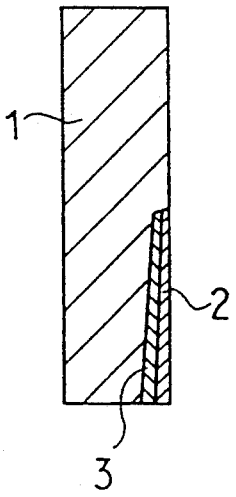
Figure 10:
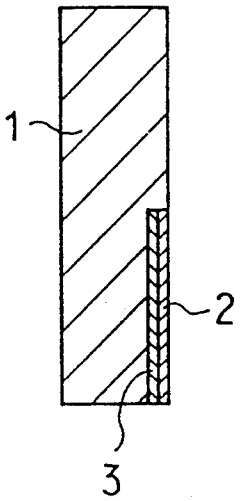

As in the direct formation of the nickel-boron alloy plating layer alone on the substrate mold body, the thickness of the boron alloy plating layer may be at least about 50 μm in the lower half of the mold body, with the total thickness of the under layer and alloy layer being about 100 μm to about 3 mm and preferably about 100 μm to about 2 mm. In the upper half of the mold body, the total thickness may be less than 100 μm and there may be neither the under layer nor the alloy layer, with the substrate copper or copper alloy being exposed. Therefore, in the present invention, the above-mentioned under layer (3) and alloy layer (2) may be formed in a tapered fashion as illustrated in FIG. 6. In this connection, the gradient of the taper may be chosen from a broad range. Generally, however, it is desirable that the total thickness of the under layer and alloy layer is about 50 μm to about 300 μm at the top end and about 150 μm to about 2 mm and preferably about 200 μm to about 1.5 mm at the bottom end. As illustrated in FIGS. 7 and 8, the under layer (3) and alloy layer (2) may be thin in the area corresponding to the upper half of the mold body and thick in the area corresponding to the lower half of the mold body. Alternatively, as illustrated in FIGS. 9 and 10, the under layer (3) and alloy layer (2) may be formed only in the area corresponding to the lower half of the mold body. In any case, in the area corresponding to the lower half of the mold body, the thickness of the alloy layer (2) should be at least about 50 μm and the total thickness of the under layer (3) and alloy layer (2) be about 100 μm to about 3 mm.

The mold of the invention having, on its substrate copper or copper alloy mold body, either a nickel-boron alloy plating layer alone or an under layer consisting essentially of at least one of nickel and cobalt and a nickel-boron alloy plating layer can be used in the continuous casting of steel into slabs, blooms, billets and other products and invariably assures an extended life.

The following examples are further illustrative of the present invention.

EXAMPLE 1

A short side mold body (250 mm wide×900 mm high) made of pure copper for continuously casting steel whose section perpendicular to its horizontal axis is substantially rectangular and having a tapered configuration with the thickness at the bottom end thereof being smaller than that at the top end by 300 μm was masked over the surface thereof except the area to be exposed to molten steel and then subjected to 30-minute electrolytic degreasing at 10 A/dm$^2$ using an iron plate as the anode. The degreased mold body was rinsed with water, 50% hydrochloric acid, water, and 3% sulfamic acid in the order mentioned for pretreatment.

The mold body was finally rinsed with water and, then, using the following plating bath, a tapered nickel-boron alloy plating layer with a boron content of 0.3 weight % was formed on the mold body at a current density of 1 to 3 A/dm$^2$, pH 3.0–4.0 and a temperature of 40° to 45° C.

| | |
|---|---|
| Nickel sulfate | 250 g/l |
| Nickel chloride | 20 g/l |
| Boric acid | 30 g/l |
| Dimethylamineborane | 0.2 g/l |

The thickness of the alloy layer was 100 μm at the top end and 400 μm at the bottom end (See FIG. 1). Then, the masking was removed.

On the other hand, a long side mold body (2200 mm wide×900 mm high) for continuously casting steel whose section perpendicular to its horizontal axis is substantially rectangular and having a tapered configuration with the thickness at its bottom end being smaller than that at the top end by 150 μm was masked over the surface thereof except the area to be exposed to molten steel and, then, using the following nickel plating bath, a nickel plating layer having a thickness of 300 μm was formed as an under layer over the entire surface of the mold body at a bath temperature of 50° C., pH 3.0 and a cathode current density of 2.0 A/dm$^2$.

| | |
|---|---|
| Nickel sulfamate | 250 g/l |
| Nickel bromide (50%) | 10 cc/l |
| Boric acid | 20 g/l |

Then, on this under layer, a tapered nickel-boron alloy plating layer with a boron content of 0.3 weight % was formed in a tapered fashion using the same nickel-boron alloy plating bath as used for the plating of the short side mold body above. The thickness of this alloy plating layer was 50 μm at the top end and 200 μm at the bottom end. The masking was then removed.

By using the mold comprising the thus plated short sides and long sides, 1300 charges of steel slabs free of any defect were produced without breakout. The mold appeared to be further usable but the production was discontinued for safety's sake. The condition of the alloy layers on the short and long sides of the above molds after use showed slight scratch marks but the mold was still useful.

EXAMPLE 2

A continuous steel casting mold bodies made of pure copper whose section perpendicular to its horizontal axis is substantially rectangular and having a tapered configuration with the thickness at the bottom end being smaller than that at the top end by 150 μm (short side: 250 mm wide×700 mm high; long side: 2200 mm wide×700 mm high) were pretreated in the same manner as described in Example 1.

After the final aqueous rinse, a 300 μm-thick nickel plating layer was formed by electroplating using a nickel sulfamate plating bath of the following composition at a temperature of 50° C., pH 3.0 and a cathode current density of 2.0 A/dm$^2$ for 18 hours.

| | |
|---|---|
| Nickel sulfamate | 250 g/l |
| Nickel bromide (50%) | 10 cc/l |
| Boric acid | 20 g/l |

After aqueous rinse and cooling, the nickel plating surface was finished so as to adjust its degree of precision by means of a stretch gauge, filler gauge and disk grinder.

After electrolytic degreasing and activation, a tapered nickel-boron alloy plating layer with a boron content of 0.3 weight % was formed using a plating bath of the following composition under the conditions of pH 3.0–4.0, bath temperature 40°–45° C. and current density 1.5 A/dm$^2$. The thickness of the alloy plating layer was 50 μm at the top end and 200 μm at the bottom end. The masking was then removed.

| | |
|---|---|
| Nickel sulfate | 250 g/l |
| Nickel chloride | 20 g/l |
| Boric acid | 30 g/l |
| Dimethylamineborane | 0.2 g/l |

Using the mold thus obtained, 1000 charges of slabs free of any defect were produced without breakout. The mold appeared to be still useful but the production was discontinued for safety's sake. The condition of the alloy layers of the above molds showed slight scratch marks but the mold was still useful.

EXAMPLE 3

The mold used in this example was a continuous bloom casting mold (inside dimension: 612 mm×392 mm, 900 mm high) which was made of copper alloy containing 0.1 weight % of iron, 0.04 weight % of tin and 0.03 weight % of phosphorus and which had substantially a rectangular section perpendicular to its horizontal axis and had a taper with the thickness at the bottom end being smaller than that at the top end by 400 μm.

The inside cavity of the mold was filled with an electrolytic degreasing solution and electrolytic degreasing was carried out in the same manner as Example 1. The degreased mold was rinsed with water, 50% hydrochloric acid, water and 3% sulfamic acid in the order mentioned for pretreatment.

Then, from an external service tank, a plating bath of the following composition was circulated into the cavity of the mold and electroplating was carried out at a current density of 3.0 A/dm$^2$, bath temperature of 40° C. and pH 4.0.

| | |
|---|---|
| Nickel sulfate | 250 g/l |
| Nickel chloride | 20 g/l |
| Boric acid | 30 g/l |
| Dimethylamineborane | 0.1 g/l |

By gradually lowering the liquid level of the plating bath, a nickel-boron alloy layer with a boron content of 0.06 weight % was formed in a tapered fashion with the thickness increasing from the top end to the lower end. Then, the surface was finished by machining to provide a tapered nickel-boron alloy layer with an evenly increasing thickness from 100 μm at the top end to 500 μm at the bottom end.

By using the mold thus obtained at a casting speed of 0.6 to 0.7 m/min, 1000 charges of blooms free of any defect were produced without breakout.

While the mold appeared to be still useful, the production was discontinued to be on the safe side. The internal surface of the mold after use revealed only slight scratch marks and no exfoliation or cracking of the nickel-boron alloy plating layer was observed, indicating that the mold was still useful.

EXAMPLE 4

In a round tubular mold made of deoxidized copper containing a trace amount of phosphorus (213 mmϕ inside diameter×900 mm high; wall thicknesses: 14.02 mm at the top end and 15.17 mm at the bottom end), a plating bath of the following composition was circulated and electroplating was carried out at a current density of 2.0 A/dm$^2$, bath temperature of 40° C. and pH 4.0.

| | |
|---|---|
| Nickel sulfate | 250 g/l |
| Nickel chloride | 20 g/l |
| Boric acid | 30 g/l |
| Dimethylamineborane | 0.2 g/l |

In this manner, a nickel-boron alloy plating layer (boron content 0.18 weight %) with a uniform thickness of 75 μm from the top end to the bottom end was formed.

By using the above mold at a casting speed of 1.9 m/min, 300 charges of carbon steel billets free of any defect were produced without breakout. While the mold appeared to be further usable, the production was discontinued to be on the safe side.

Observation of the internal side of the mold revealed only slight scratch marks and no exfoliation or cracking of the nickel-boron alloy layer was observed, indicating that the mold was still useful.

With a mold fabricated as above except that a nickel plating layer was used in lieu of the above nickel-boron alloy layer, only 120 charges of carbon steel billets could be produced and the mold after production revealed a wear of the nickel layer, with local exposure of the substrate copper, and could not be further usable.

I claim:

1. A copper or copper alloy mold for continuous casting of steel comprising a copper or copper alloy mold having formed on its internal surface a plating layer consisting of a nickel-boron alloy having a boron content of about 0.06 to 0.3 weight %, the plating layer having a thickness of about 50 μm to about 2 mm.

2. The mold of claim 1 wherein said nickel-boron alloy plating layer has a thickness of about 50 μm to about 2 mm in the area corresponding to the lower half of the mold.

* * * * *